US007015635B2

(12) United States Patent
Jung

(10) Patent No.: US 7,015,635 B2
(45) Date of Patent: Mar. 21, 2006

(54) COLOR CATHODE RAY TUBE

(75) Inventor: Sung-Han Jung, Kyeongsangbuk-Do (KR)

(73) Assignee: LG.Philips Displays Korea Co., Ltd., Kyeongsangbuk-Do (KR)

( * ) Notice: Subject to any disclaimer, the term of this patent is extended or adjusted under 35 U.S.C. 154(b) by 194 days.

(21) Appl. No.: 10/763,332

(22) Filed: Jan. 26, 2004

(65) Prior Publication Data

US 2005/0007005 A1 Jan. 13, 2005

(30) Foreign Application Priority Data

Jul. 10, 2003 (KR) ..... 10-2003-0046914

(51) Int. Cl.
*H01J 30/00* (2006.01)
*H01J 29/00* (2006.01)

(52) U.S. Cl. ..... 313/461; 313/364; 313/477 R; 220/2.1 A; 220/2.1 R; 348/822; 348/823; 348/824; 348/825; 348/826

(58) Field of Classification Search ..... 313/461, 313/364, 477 R; 220/2.1 A, 2.1 R; 445/8; 348/822–825
See application file for complete search history.

(56) References Cited

U.S. PATENT DOCUMENTS 5,053,880 A * 10/1991 Swank ..... 348/822
5,445,285 A * 8/1995 Sugawara et al. ..... 220/2.1 A
6,488,166 B1 * 12/2002 Swank et al. ..... 220/2.1 R
6,815,882 B1 * 11/2004 Murakami et al. ..... 313/477 R
6,833,664 B1 * 12/2004 Park et al. ..... 313/479

* cited by examiner

*Primary Examiner*—Ashok Patel
*Assistant Examiner*—Gabriel Olander
(74) *Attorney, Agent, or Firm*—Birch, Stewart, Kolasch & Birch, LLP

(57) ABSTRACT

Disclosed is a color CRT capable of obtaining the safety for an explosion by setting a band force of a reinforcing band coupled to a flat panel to be optimum, wherein a ratio of an effective surface of the panel is 4:3 and a following condition $0.0426*U^2-46.848*U+14095 \leqq T*W*Yp \leqq 0.0381*U^2-35.517*U+9994.1$ is satisfied.

8 Claims, 7 Drawing Sheets

COLOR CATHODE RAY TUBE

This Nonprovisional application claims priority under 35 U.S.C. §119(a) on patent application Ser. No(s). 10-2003-0046914 filed in KOREA on Jul. 10, 2003, the entire contents of which are hereby incorporated by reference.

BACKGROUND OF THE INVENTION

1. Field of the Invention

The present invention relates to a color cathode ray tube (CRT), and more particularly, to a color CRT in which a band force of a reinforcing band is set with an optimum condition for an explosion proof of the color CRT.

2. Description of the Related Art

Generally, a color CRT is a device for displaying images, and is divided into a curved surface CRT and a flat CRT according to an outer shape of a panel.

The curved CRT having an outer surface of a curved surface has several problems such as a screen distortion, eyes fatigue due to a light reflection, and etc. thereby to have decreased demands. On the contrary, the flat CRT having an outer surface of a plane has many advantages that a screen is not distorted, reflection by external light is minimized, and a visual region is maximized, so that demands for the flat CRT are being increased gradually.

FIG. 1 is a longitudinal section view showing a color CRT in accordance with the related art, FIG. 2 is a section view showing a single reinforcing band, and FIG. 3 is a section view showing an overlapped reinforcing band.

As shown, the size color CRT 10 comprises: a panel 1 having an effective surface on which a phosphor 1*a* is deposited; a mask 2 for performing a color selection for an electron beam made to be incident on the inner side of the panel 1; a funnel 3 coupled to a rear surface of the panel 1 for maintaining a vacuum state inside the CRT; a deflection yoke 5 for deflecting an electron beam emitted from an electron gun 4; and a reinforcing band 6 coupled to a skirt portion 1*b* of the panel 1.

In the related color CRT, when an image signal is inputted to the electron gun 4, the electron gun 4 emits an electron beam and the emitted electron beam is accelerated and focused towards the phosphor 1*a* of the panel 1 by a voltage applied from each electrode.

At this time, the electron beam is deflected by the deflection yoke 5 and then passes through slots formed at the mask 2 thereby to perform a color selection. Then, the electron beam collides with the phosphor 1*a* of the inner surface of the panel 1 thus to make each phosphor emit light, thereby displaying images.

At this time, since the color CRT maintains a vacuum state by the panel and the funnel, a compression stress or a tension stress is applied to the inside and outside of the CRT.

Since glass generally has a weak characteristic against the tension stress than the compression stress, a side portion of the panel becomes structurally weak than other portions.

Also, when a little external impact is applied in a state that the compression stress and the tension stress are applied to the CRT of a vacuum state, an explosion phenomenon that the panel or the funnel are exploded is generated. The explosion phenomenon makes the CRT not be operated and causes danger to the user's safety. To prevent this, a reinforcing band 6 is coupled to the skirt portion 1*b* of the panel 1. The reinforcing band 6 is positioned to cover a mold match line M which is naturally formed at the time of forming the panel. The reinforcing band 6 shown in FIG. 2 is a single type, and the reinforcing band 6 shown in FIG. 3 is an overlapped type.

Generally, a band force F of the reinforcing band can be expressed as a following condition, F=yield strength*thickness of reinforcing band*width of reinforcing band. Herein, since the yield strength is generally determined by a material of the reinforcing band, setting the thickness of the reinforcing band and the width of the reinforcing band is very important so as to set an optimum band force.

However, in the related color CRT, the band force of the reinforcing band applied to the panel was not set as an optimum state but was set to be too great or less.

When the set band force is too less than an optimum band force, a stress of the panel is not sufficiently released thus to have a difficulty in obtaining the safety. On the contrary, when the set band force is too greater than the optimum band force, a fabrication cost of the reinforcing band is increased even if the safety can be obtained.

According to this, an optimum setting of the band force which minimizes the fabrication cost of the reinforcing band and obtains the safety for the explosion is absolutely required.

SUMMARY OF THE INVENTION

Therefore, an object of the present invention is to provide a color CRT capable of obtaining a user's safety against an explosion of a CRT by setting a band force of a reinforcing band as an optimum condition.

To achieve these and other advantages and in accordance with the purpose of the present invention, as embodied and broadly described herein, there is provided a color CRT comprising: a panel having a substantially flat outer surface and an inner surface having a predetermined curvature; a funnel coupled to a rear surface of the panel; and a reinforcing band coupled to a skirt portion of the panel in order to prevent an explosion of the panel and the funnel; wherein an aspect ratio of an effective surface of the panel is 4:3 and a following condition $0.0426*U^2-46.848*U+14095 \leqq T*W*Yp \leqq 0.0381*U^2-35.517*U+9994.1$ is satisfied, wherein U denotes a diagonal size of the effective surface of the panel, T denotes a thickness of the reinforcing band, W denotes a width of the reinforcing band, Yp denotes a yield strength of the reinforcing band, and T*W*T*Yp denotes a band force F of the reinforcing band.

To achieve these and other advantages and in accordance with the purpose of the present invention, as embodied and broadly described herein, there is also provided a color CRT comprising: a panel having a substantially flat outer surface and an inner surface having a predetermined curvature; a funnel coupled to a rear surface of the panel; and a reinforcing band coupled to a skirt portion of the panel in order to prevent an explosion of the panel and the funnel; wherein an aspect ratio of an effective surface of the panel is 16:9 and a following condition $2.3333*U+252 \leqq T*W*Yp \leqq 7*U-2268$ is satisfied, wherein U denotes a diagonal size of the effective surface of the panel, T denotes a thickness of the reinforcing band, W denotes a width of the reinforcing band, Yp denotes a yield strength of the reinforcing band, and T*W*T*Yp denotes a band force F of the reinforcing band.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a color CRT according to the present invention will be explained with reference to the attached drawings.

Figure 1:
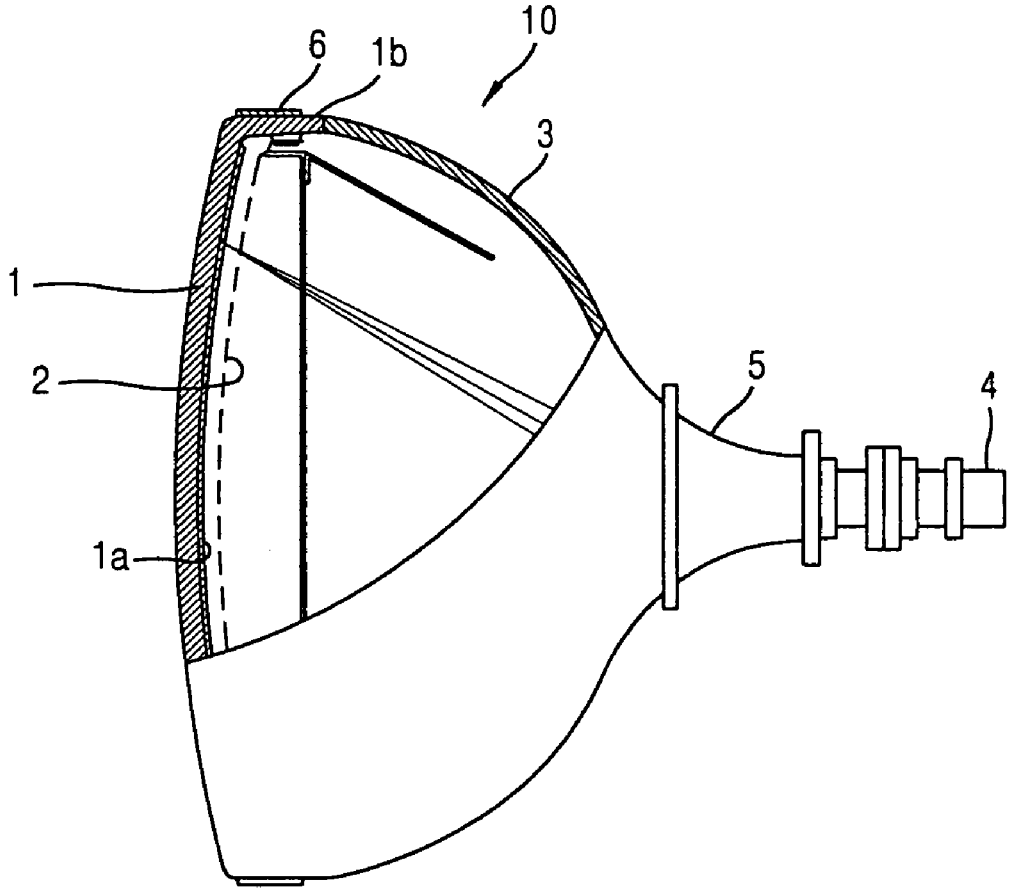
FIG. 1 RELATED ART
FIG. 1 is a longitudinal section view showing a color CRT in accordance with the related art.
Figure 2:
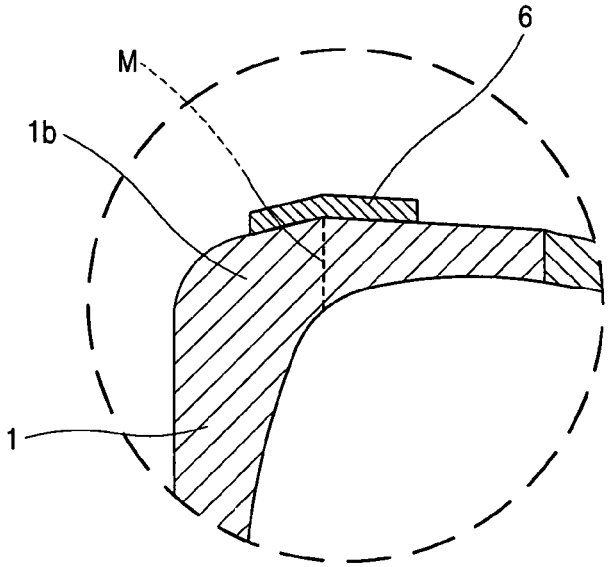
FIG. 2 is a section view showing a single reinforcing band.
Figure 3:
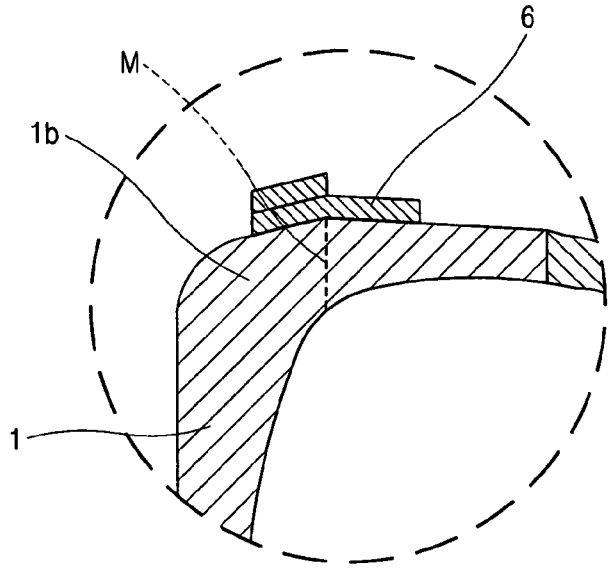
FIG. 3 is a section view showing an overlapped reinforcing band.
Figure 4:
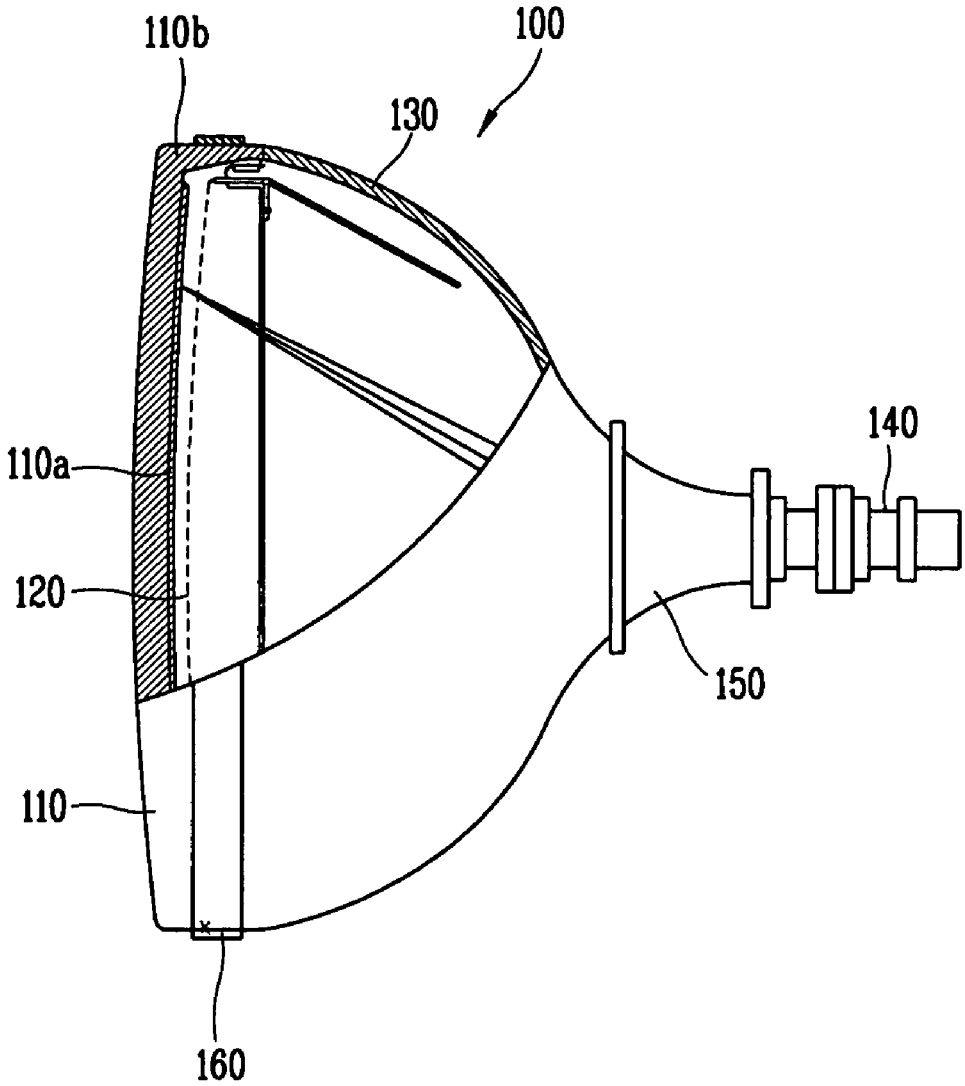
FIG. 4 is a longitudinal section view showing a color CRT according to the present invention.

FIG. 4 is a longitudinal section view showing the color CRT according to the present invention.

A safety standard such as UL (U.S.A) and CSA (Canada) is obligatorily applied to a color CRT for a safety structure. According to this, the color CRT according to the present invention corresponds to the safety standard and reduces a fabrication cost by setting a band force range of a reinforcing band per each effective surface size of a panel, a relation between a diagonal size of an effective surface of the panel and an inner curvature radius, and a thickness of the reinforcing band as an optimum state and by forming an embossment at the reinforcing band.

As shown in FIG. 4, the color CRT 100 according to the present invention comprises: a panel 110 having an effective surface and a substantially flat outer surface; a mask 120 for performing a color selection for an electron beam made to be incident on a fluorescent film 110*a* of the panel 110; a funnel 130 coupled to a rear surface of the panel 110; a deflection yoke 150 for deflecting an electron beam emitted from an electron gun 140; and a reinforcing band 160 coupled to a skirt portion 110*b* of the panel 110.

Figure 5:
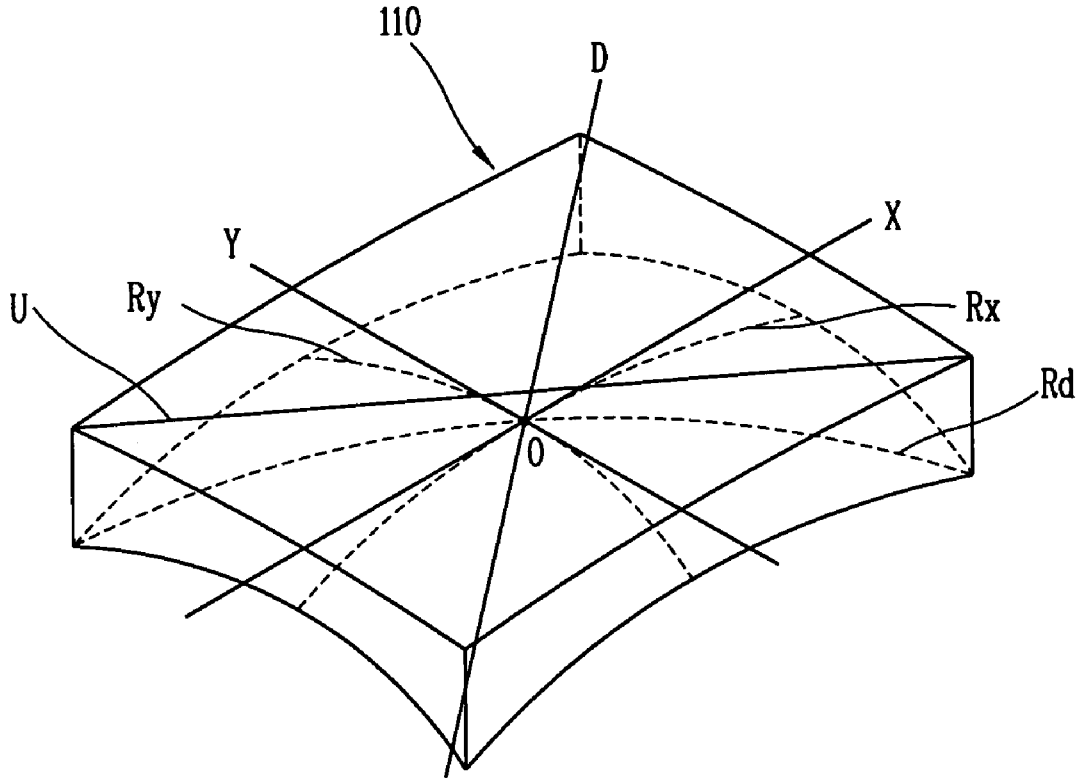
FIG. 5 is a perspective view showing an effective surface of a panel of the color CRT according to the present invention.
Figure 6A:
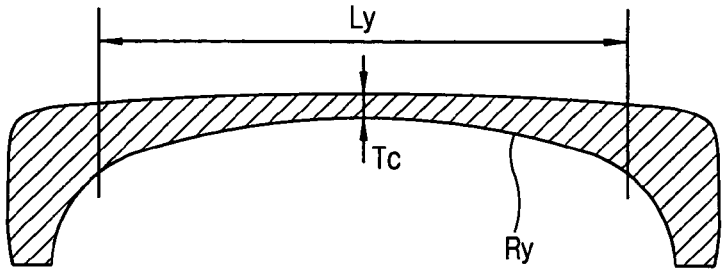
FIG. 6A is a longitudinal section view showing an inner surface curvature radius of a panel along a short axis Y.
Figure 6B:
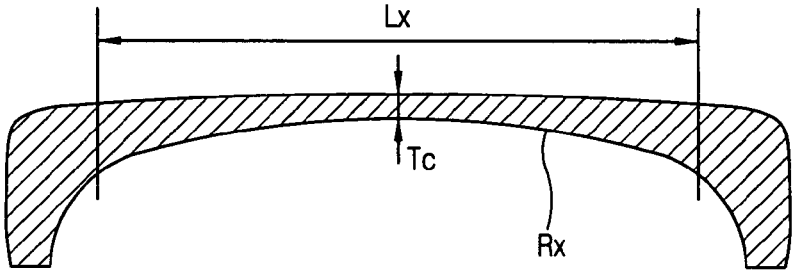
FIG. 6B is a longitudinal section view showing an inner surface curvature radius of a panel along a long axis X.
Figure 6C:
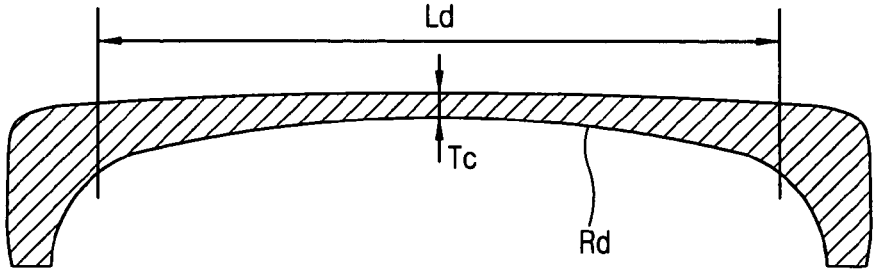
FIG. 6C is a longitudinal section view showing an inner surface curvature radius of a panel along a diagonal axis D.
Figure 7:
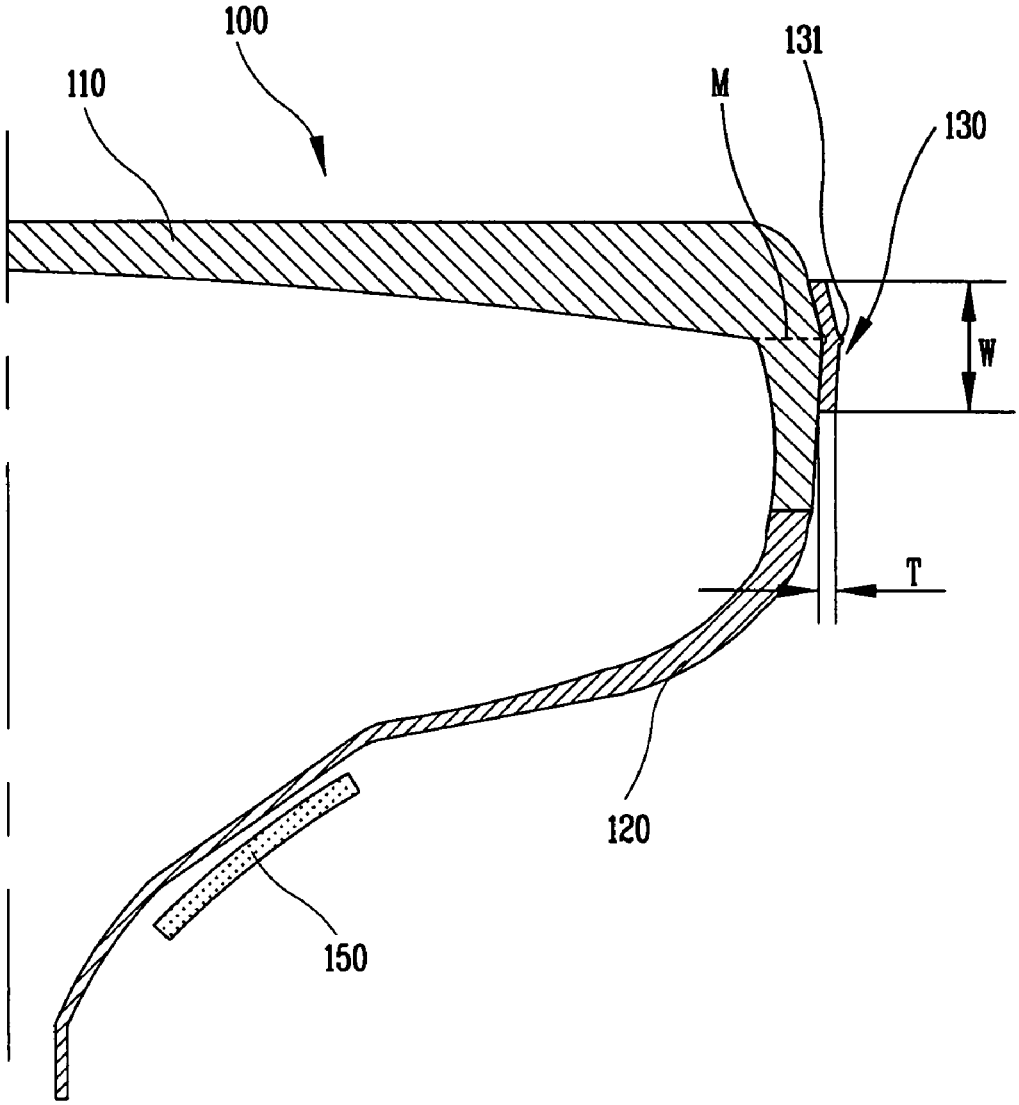
FIG. 7 is a section view showing a coupling of a reinforcing band in the color CRT according to the present invention.

FIG. 5 is a perspective view showing an effective surface of a panel of the color CRT according to the present invention, FIG. 6A is a longitudinal section view showing an inner surface curvature radius of a panel along a short axis Y, FIG. 6B is a longitudinal section view showing an inner surface curvature radius of a panel along a long axis X, and FIG. 6C is a longitudinal section view showing an inner surface curvature radius of a panel along a diagonal axis D.

In the present invention, an aspect ratio of an effective surface of the panel is 4:3 and a following condition $0.0426*U^2-46.848*U+14095 \leqq T*W*Yp \leqq 0.0381*U^2-35.517*U+9994.1$ is satisfied, wherein U denotes a diagonal size of the effective surface of the panel, T denotes a thickness of the reinforcing band, W denotes a width of the reinforcing band, Yp denotes a yield strength of the reinforcing band, and T*W*T*Yp denotes a band force F of the reinforcing band. Also, Rh is supposed to be a value obtained by dividing an inner curvature radius Rx of the effective surface of the panel along the long axis X by 1.767*a size Lx of the effective surface along the long axis, Rv is supposed to be a value obtained by dividing an inner curvature radius Ry of the effective surface of the panel along the short axis Y by 1.767*a size Ly of the effective surface along the short axis, and Ro is supposed to be a value obtained by dividing an inner curvature radius Rd of the effective surface of the panel along the diagonal axis D by 1.767*a size Ld of the effective surface along the diagonal axis.

Preferably, in the color CRT according to the present invention, following conditions $0.03 \leqq (Rh*Rv*Ro)/U \leqq 0.12$ and $1.0 \leqq T \leqq 1.8$ are satisfied.

Also, an embossment 131 is formed at one side of the reinforcing band 130 corresponding to a mold match line M of the panel 110.

The embossment 131 prevents a movement of a cabinet and the reinforcing band 130 by maintaining a compatibility with the size cabinet (not shown), and enhances an entire intensity of the reinforcing band 130.

At the time of reproducing an inferior color CRT, the reinforcing band is released at a part where the reinforcing band is in contact with the panel. At this time, the reinforcing band springs out by its own elasticity thus to generate a minute crack on the mold match line part of the panel.

However, in the color CRT according to the present invention, the embossment is formed at a surface corresponding to the mold match line part among the entire surface of the reinforcing band, thereby preventing the minute crack which can be generated at the time of reproducing the color CRT.

Also, in the present invention, an aspect ratio of the effective surface of the panel is 16:9 and a following condition $2.3333*U+252 \leqq T*W*Yp \leqq 7*U-2268$ is satisfied.

Hereinafter, a band force according to a diagonal size of the effective surface of the panel will be explained with reference to FIGS. 8 and 9.

Figure 8:
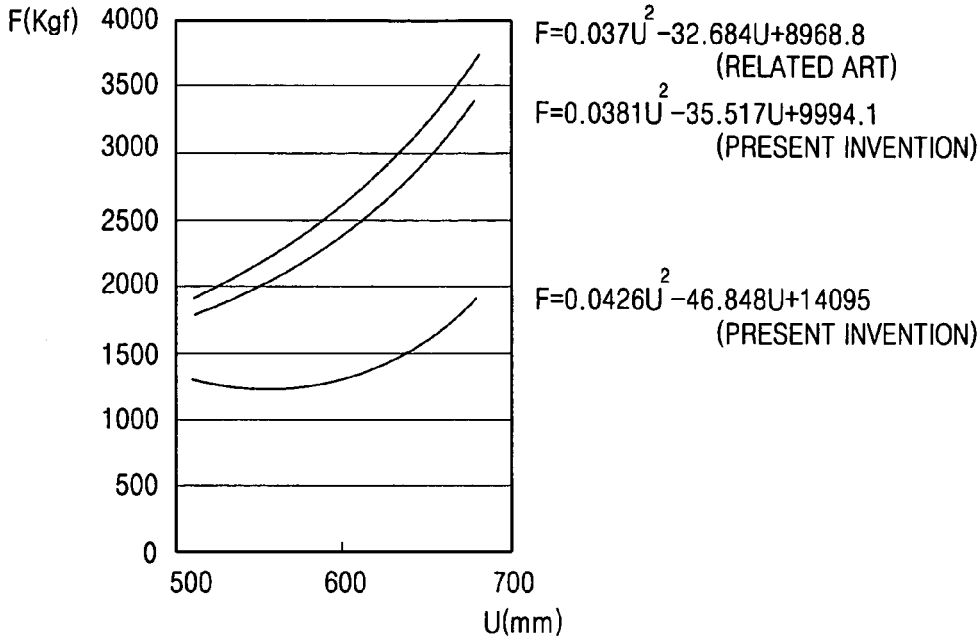
FIG. 8 is a graph showing one embodiment of an optimum band force according to a diagonal size U of an effective surface of a panel.

FIG. 8 is a graph showing one embodiment of an optimum band force according to a diagonal size U of the effective surface of the panel.

As shown, the band force F of the reinforcing band is set within a range of $0.0426*U^2-46.848*U+14095 \sim 0.0381*U^2-35.517*U+9994.1$.

For example, in case of a panel of 21" (U: 510 mm), the band force of the reinforcing band is set to be 1280 kgf–1792 kgf.

When the band force of the reinforcing band is set to be less than 1280 kgf, a stress of the panel is not sufficiently released thus to have a difficulty in obtaining the safety against an explosion.

On the contrary, when the band force of the reinforcing band is set to be more than 1792 kgf, a width or a thickness of the reinforcing band become too great thus to increase a fabrication cost even if the safety against an explosion can be obtained.

Accordingly, in the color CRT of the present invention, the band force F of the reinforcing band is set within a range of $0.0426*U^2-46.848*U+14095 \sim 0.0381*U^2-35.517*U+9994.1$ in order to reduce the fabrication cost and to obtain the safety for explosion.

TABLE 1

| | Band force and thickness | |
|---|---|---|
| diagonal size | Band force of the present invention(kgf) | Thickness of the reinforcing band of the present invention (mm) |
| U: 510 mm, 21" | 1280–1792 | 1.0–1.4 |
| U: 590 mm, 25" | 1280–2304 | 1.0–1.8 |
| U: 676 mm, 29" | 1888–3398 | 1.0–1.8 |

The above table 1 shows the embodiment of the present invention in case that the diagonal size U of the effective surface of the panel is 510 mm, 590 mm, and 676 mm. According to the table 1, the width and thickness of the reinforcing band are minimized and the band force is optimized thereby to obtain the safety against an explosion and to reduce a fabrication cost.

Figure 9:
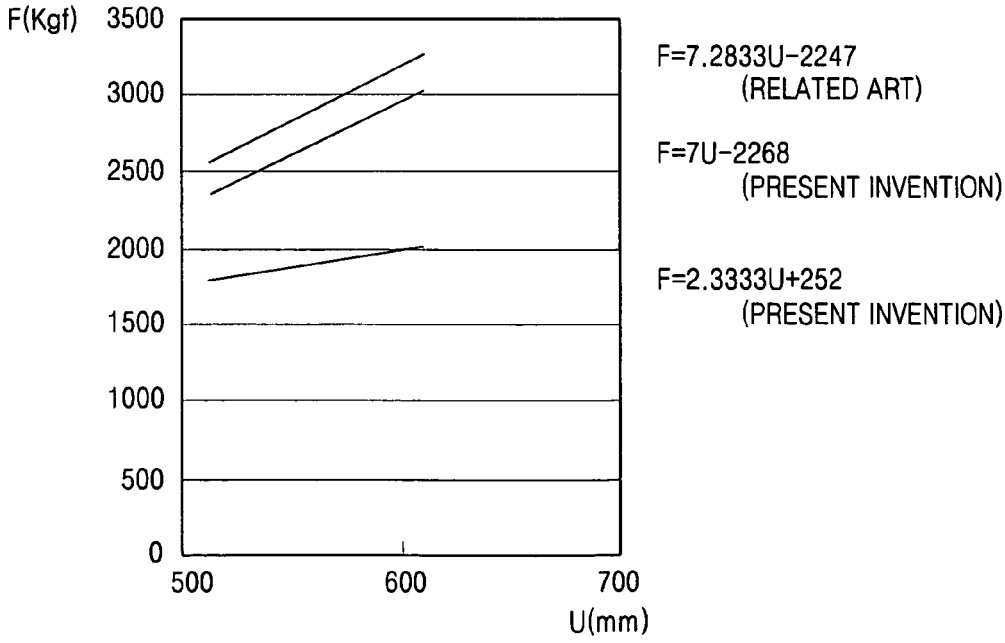
FIG. 9 is a graph showing another embodiment of the optimum band force according to a diagonal size U of an effective surface of a panel.

FIG. 9 is a graph showing another embodiment of the optimum band force according to the diagonal size U of the effective surface of the panel.

As shown, the band force F of the reinforcing band is set within a range of $2.3333*U+252 \sim 7*U-2268$.

For example, in case of a panel of 28" (U: 660 mm), the band force of the reinforcing band is set to be 1792 kgf–2352 kgf.

When the band force of the reinforcing band is set to be less than 1792 kgf, a stress of the panel is not sufficiently released thus to have a difficulty in obtaining the safety against an explosion.

On the contrary, when the band force of the reinforcing band is set to be more than 2352 kgf, a width or a thickness of the reinforcing band become too great thus to increase a fabrication cost even if the safety against an explosion can be obtained.

Accordingly, in the color CRT of the present invention, the band force F of the reinforcing band is set within a range of $2.3333*U+252 \sim 7*U-2268$ in order to reduce the fabrication cost and to obtain the safety for explosion.

In case that the diagonal size U of the effective surface of the panel is respectively 660 mm and 756 mm, the band force and the thickness of the reinforcing band in the color CRT according to the present invention are shown in the following table 2.

TABLE 2

| | Band force and thickness | |
|---|---|---|
| diagonal size | Band force of the present invention(kgf) | Thickness of the reinforcing band of the present invention(mm) |
| U: 660 mm, 28" | 1792–2352 | 1.0–1.5 |
| U: 756 mm, 32" | 2016–3024 | 1.0–1.5 |

The above table 2 shows the embodiment of the present invention in case that the diagonal size U of the effective surface is respectively 660 mm and 756 mm, in which the thickness of the reinforcing band is minimized and the band force is optimized thereby to obtain the safety for an explosion and to reduce the fabrication cost of the reinforcing band.

As aforementioned, according to the present invention, the band force of the reinforcing band coupled to the flat panel is set to be optimum thereby to obtain the safety for an explosion of the CRT, and the thickness and width of the reinforcing band are minimized thereby to reduce the fabrication cost.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A color CRT comprising:

a panel having a substantially flat outer surface and an inner surface having a predetermined curvature;

a funnel coupled to a rear surface of the panel; and a reinforcing band coupled to a skirt portion of the panel in order to prevent an explosion of the panel and the funnel;

wherein an asepct ratio of an effective surface of the panel is 4:3 and a following condition $0.0426*U^2-46.848*U+14095 \leqq T*W*Yp \leqq 0.0381*U^2-35.517*U+9994.1$ is satisfaed;

wherein U denotes a diagonal size of the effective surface of the panel in mm, T denotes a thickness of the reinforcing band, W denotes a width of the reinforcing band, Yp denotes a yield strength of the reinforcing band, and T*W*T*Yp denotes a band force F of the reinforcing band.

2. A color CRT comprising:

a panel having a substantially flat outer surface and an inner surface having a predetermined curvature;

a funnel coupled to a rear surface of the panel; and a reinforcing band coupled to a skirt portion of the panel in order to prevent an explosion of the panel and the funnel;

wherein an aspect ratio of an effective surface of the panel is 16:9 and a following condition $2.3333*U+252 \leqq T*W*Yp \leqq 7*U-2268$ is satisfied, wherein U denotes a diagonal size of the effective surface of the panel in mm, T denotes a thickness of the reinforcing band, W denotes a width of the reinforcing band, Yp denotes a yield strength of the reinforcing band, and T*W*T*Yp denotes a band force F of the reinforcing band.

3. The color CRT of claim 1, wherein a following condition $0.03 \leqq (Rh*Rv*Ro)/U \leqq 0.12$ is satisfied, wherein the Rh is a value obtained by dividing an inner curvature radius Rx of the effective surface of the panel along the long axis X by 1.767*a size Lx of the effective surface along the long axis, the Rv is supposed to be a value obtained by dividing an inner curvature radius Ry of the effective surface of the panel along the short axis Y by 1.767*a size Ly of the effective surface along the short axis, and the Ro is supposed to be a value obtained by dividing an inner curvature radius Rd of the effective surface of the panel along the diagonal axis D by 1.767*a size Ld of the effective surface along the diagonal axis.

4. The color CRT of claim 1, wherein a following condition $1.0 \leqq T \leqq 1.8$ is satisfied.

5. The color CRT of claim 2, wherein an embossment is formed at one side of the reinforcing band corresponding to a mold match line of the panel.

6. The color CRT of claim 2, wherein a following condition $0.03 \leqq (Rh*Rv*Ro)/U \leqq 0.12$ is satisfied.

7. The color CRT of claim 2, wherein a following condition $1.0 \leqq T \leqq 1.5$ is satisfied.

8. The color CRT of claim 1, wherein an embossment is formed at one side of the reinforcing band corresponding to a mold match line of the panel.

* * * * *